US008335334B1

(12) United States Patent
Luna Rosas et al.

(10) Patent No.: US 8,335,334 B1
(45) Date of Patent: Dec. 18, 2012

(54) HEADSET CONVERTIBLE TO MONAURAL, BINAURAL OR STEREO CONFIGURATION

(75) Inventors: Luis M. Luna Rosas, Tijuana (MX); Pedro A. Rivas Huerta, Tijuana (MX)

(73) Assignee: Plantronics, Inc., Santa Cruz, CA (US)

( * ) Notice: Subject to any disclaimer, the term of this patent is extended or adjusted under 35 U.S.C. 154(b) by 1391 days.

(21) Appl. No.: 11/492,280

(22) Filed: Jul. 24, 2006

(51) Int. Cl.
*H04R 25/00* (2006.01)

(52) U.S. Cl. ..... 381/370; 381/374; 381/379

(58) Field of Classification Search ..... 381/370, 381/374, 375, 376, 378, 379, 381, 322, 324, 381/330, 384; 379/430; 181/129
See application file for complete search history.

(56) References Cited

U.S. PATENT DOCUMENTS

| | | | | | |
|---|---|---|---|---|---|
| 2,930,856 | A | * | 3/1960 | Toht | 381/330 |
| 4,542,803 | A | * | 9/1985 | Houng | 181/129 |
| 4,783,822 | A | * | 11/1988 | Toole et al. | 381/379 |
| 4,875,233 | A | * | 10/1989 | Derhaag et al. | 379/430 |
| 5,117,464 | A | * | 5/1992 | Jones et al. | 381/379 |
| 2005/0157903 | A1 | | 7/2005 | Bech | |

* cited by examiner

*Primary Examiner* — Huyen D Le
(74) *Attorney, Agent, or Firm* — William Winters; Michael Rodriguez

(57) ABSTRACT

A convertible headset includes a headband having first and second ends, a first speaker affixed to the first end of the headband, and a termination member connected to the second end of the headband designed to be removably connectable to the second end of the headband.

12 Claims, 7 Drawing Sheets

HEADSET CONVERTIBLE TO MONAURAL, BINAURAL OR STEREO CONFIGURATION

FIELD OF THE INVENTION

The present invention relates generally to the field of sound transducers, including telephonic headsets and headsets used with computers, computer gaming and other electronic equipment.

BACKGROUND OF THE INVENTION

Many different headset devices have been used to position and stabilize an audio transducer or speaker adjacent to a user's ear or ears to deliver audio communication to the user.

A common style of headset is a headband headset having either one or two speakers (monaural or binaural, respectively) that fit over the wearer's ear or ears and are connected by a band between them. The band is constructed in arcuate form from a resilient material, usually including a plastic section that slides up and down, allowing the user to adjust band size and tension. A monaural type of headset includes a single speaker mounted to the headband, and opposite the speaker a temple pad is affixed to the headband. In the binaural type of device two speakers are included, one mounted at each end of the headband. The binaural style can be either monophonic or stereophonic, depending on whether the same signal is delivered to each speaker or different signals are delivered to the two speakers.

In headsets used for telephonic or other similar type communications, a microphone may also be positioned in the vicinity of the user's mouth, usually by a tubular extension, voice tube, or boom, for receiving the user's voice and transmitting it over the communications link.

Present designs of headsets require a user to purchase two different types of headsets, monaural and binaural. Also, in some cases the user must purchase one design to deliver monophonic sound and another to deliver stereophonic sound. Accordingly, what is needed is a headband headset which can be easily converted between a monaural type and a binaural type by the user.

SUMMARY OF THE INVENTION

The present headset provides ease of conversion between monaural and binaural modes and also simplifies manufacturing processes since many of the components of the monaural device are the same as those of the binaural device.

The headset includes a headband, which has an arcuate portion having a first end and a second end. The headband is made of resilient material so that a user can easily mount it on the head and remove it therefrom, and when mounted on the head the ends are biased toward each other to help the headset stay in place.

A first speaker is permanently connected to the first end of the headband, and a microphone can be connected to a housing of the first speaker. Electrical wiring is connected to the first speaker to carry electrical signals from a source, such as a computer or portable electronic device, to the headset. A temple pad is removably connected to the second end of the headband. The temple pad does not include a speaker, and the primary purpose of the temple pad is to contact the user's head and be biased by the headband toward the first speaker to help keep the headset in place on the user's head.

A user can easily convert the monaural headset system to a binaural system. To do so, the user removes the temple pad and replaces it with a speaker module containing a second speaker. The user accomplishes this by first disengaging a locking member which can releasably lock the headband to the temple pad, and then the user replaces the temple pad with the speaker module and locks the speaker module in place.

DETAILED DESCRIPTION

Figure 1:
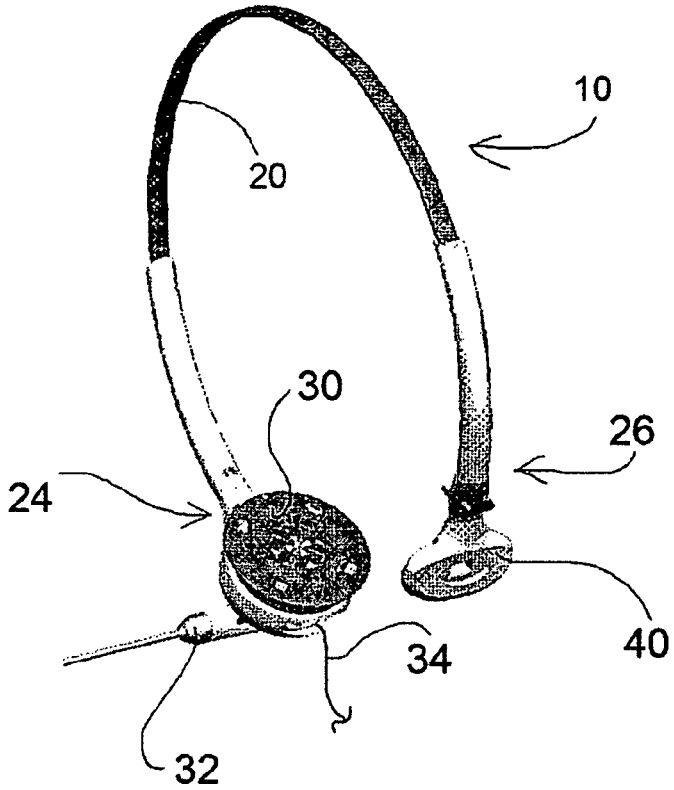
FIG. 1 is an isometric view of a convertible headset in a monaural configuration, according to an embodiment of the present invention in a monaural configuration.

With reference now to FIG. 1, there is illustrated one embodiment of a headset in accordance with the present invention. The headset 10 includes a headband 20, which is arcuate, having a first end 24 and a second end 26. The headband 20 is made of resilient material so that a user can easily mount it on the head and remove it therefrom, and when mounted on the head the ends 24 and 26 are biased toward each other to help the headset stay in place.

A first speaker 30 is permanently connected to the first end 24 of the headband 20, and a microphone 32 is connected to a housing of the first speaker 30. Electrical wiring 34 is connected to the first speaker 30 to carry electrical signals from a source, not shown, to the headset. The first speaker 30, the microphone 32 and the wiring 34 are all conventional and therefore will not be discussed in detail herein.

A temple pad 40 is removably connected to the second end 26 of the headband 20. The temple pad 40 does not include a speaker, and the primary purpose of the temple pad 40 is to contact the user's head and be biased by the headband 20 toward the first speaker 30 to help keep the headset in place on the user's head.

Figure 2:
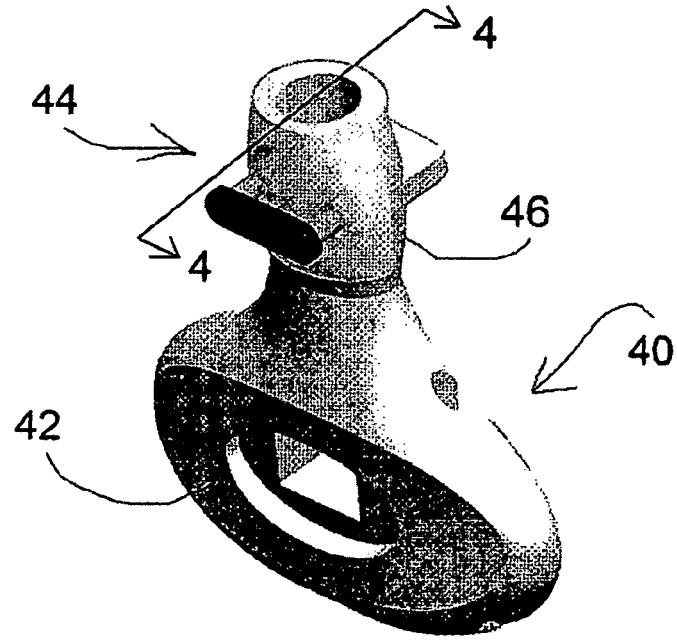
FIG. 2 is an isometric view of a temple pad of the headset of FIG. 1.
Figure 3:
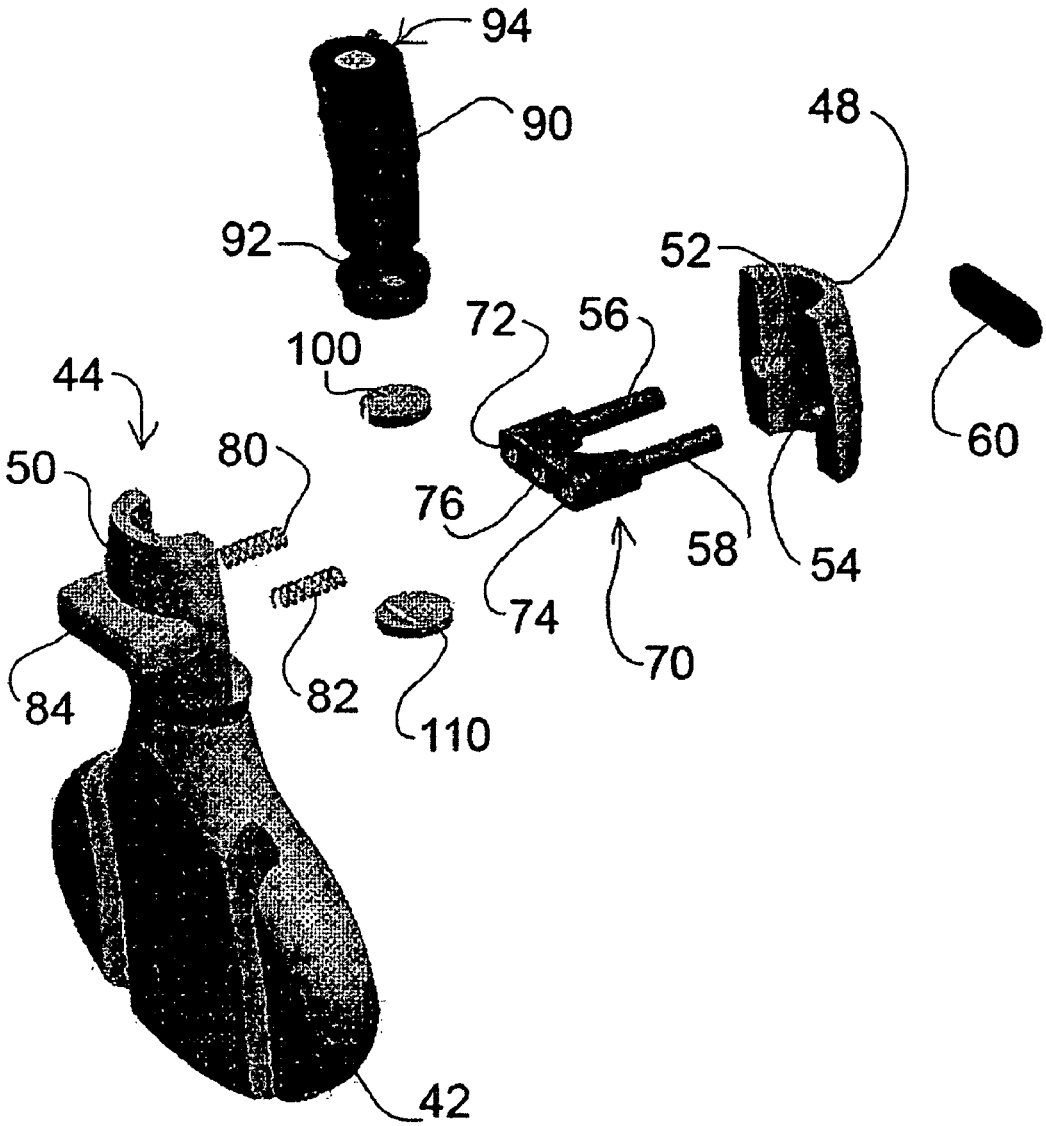
FIG. 3 is an exploded, isometric view of the temple pad and part of the headband of the headset.
Figure 4:
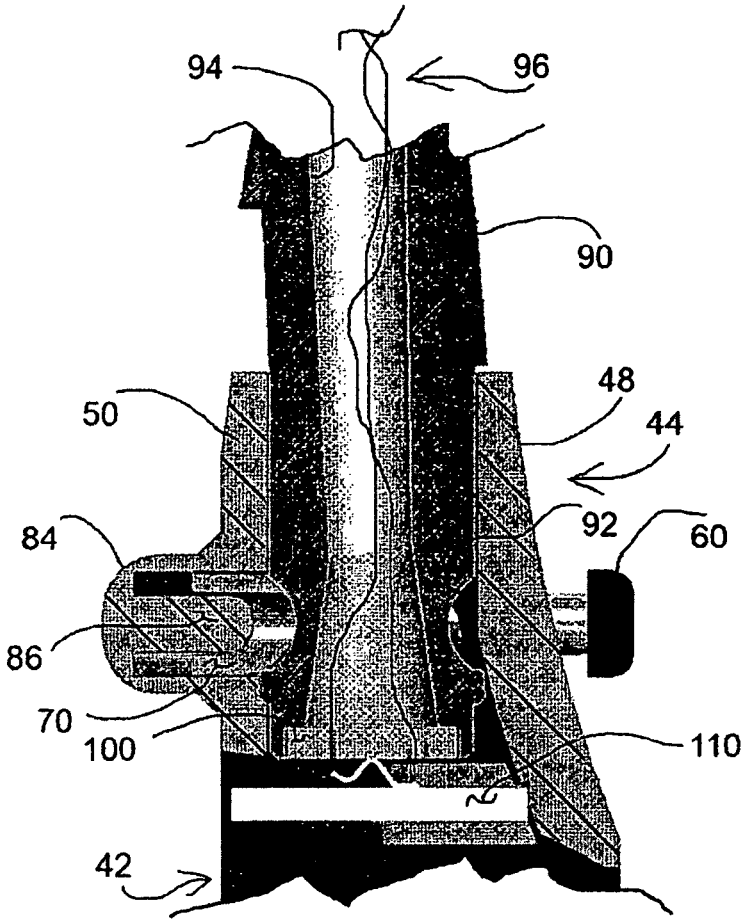
FIG. 4 is a sectional view of a part of the headband taken along line 4-4 of FIG. 2.

FIGS. 2-4 show elements of the headset 10 in more detail. As shown in FIG. 2, the temple pad 40 includes a T-shaped member 42 and a lock assembly 44. The lock assembly 44, which is shown in greater detail in FIG. 3, includes a hollow barrel 46 comprising a first barrel part 48 and a second barrel part 50. The first barrel part 48 has two holes 52 and 54 formed through its sides to cooperate with two cylindrical pins 56 and 58 extending from an engagement member 70. A plate 60 is mounted to the ends of the pins 56 and 58, which are exterior of the barrel 48, and an engagement member 70 is mounted to the ends of the pins 56 and 58, which are interior of the barrel 48.

The engagement member 70 is generally U-shaped. Two blind holes 72 and 74 are formed in a base of the U along axes coincident with longitudinal axes of the pins 56 and 58. A third hole 76 is formed in the middle of the base of the U. First and second springs 80 and 82 are configured in the two blind holes 72 and 74. The springs 80 and 82 bias the engagement member 70 away from the second barrel part 50. A well 84 is formed in the second barrel part 50 to cooperate with the springs 80 and 82 in the base of the engagement member 70. The well 84 includes a pin 86 to cooperate with the third hole 76 in the center of the base of the engagement member 70.

A connection cylinder 90 is mounted in the second end 26 of the headband 20 so that the proximal end of the cylinder 90 is engaged in the headband 20 while the distal end of the cylinder 90 extends from the headband 20. The exposed end of the cylinder 90 includes a channel 92 formed about its circumference. As explained in more detail below, a user can push the plate 60 toward the second barrel part 50 to cause the engagement member 70 to move against the force of the springs, thereby disengaging the engagement member 70 from the channel 92 of the connection cylinder 90. The cylinder 90 also includes a through hole 94 through which electrical wires are 96 passed.

Figure 5:
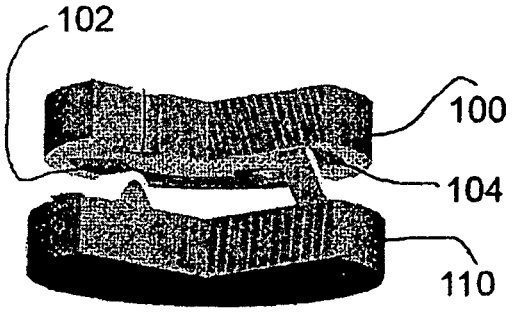
FIG. 5 is a view of electrical connectors of the headset of FIG. 1 with part broken away.
Figure 6:
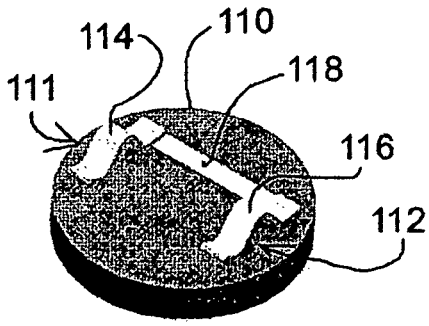
FIG. 6 is another view of an electrical connector of FIG. 5.
Figure 13:
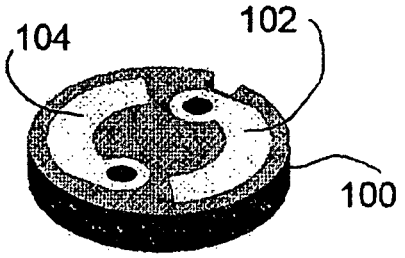
FIG. 13 is a view of an electrical connector of the headset.

A first electrical connector 100 is mounted at the distal end of the connection cylinder 90. The connector 100 is cylindrical and includes two semicircular shaped electrical contacts 102 and 104 formed on the distal side of the connector 100, as best shown in FIGS. 5 and 13. The contacts 102 and 104 are connected to the wires 96.

A second electrical connector 110 is mounted in the temple pad 40. The second electrical connector 110 is substantially cylindrical and includes two electrical contacts 111 and 112. The two electrical contacts 111 and 112 have raised spring portions 114 and 116 that extend from the second electrical connector 110 and are electrically coupled to each other by a shunt 118.

Figure 7:
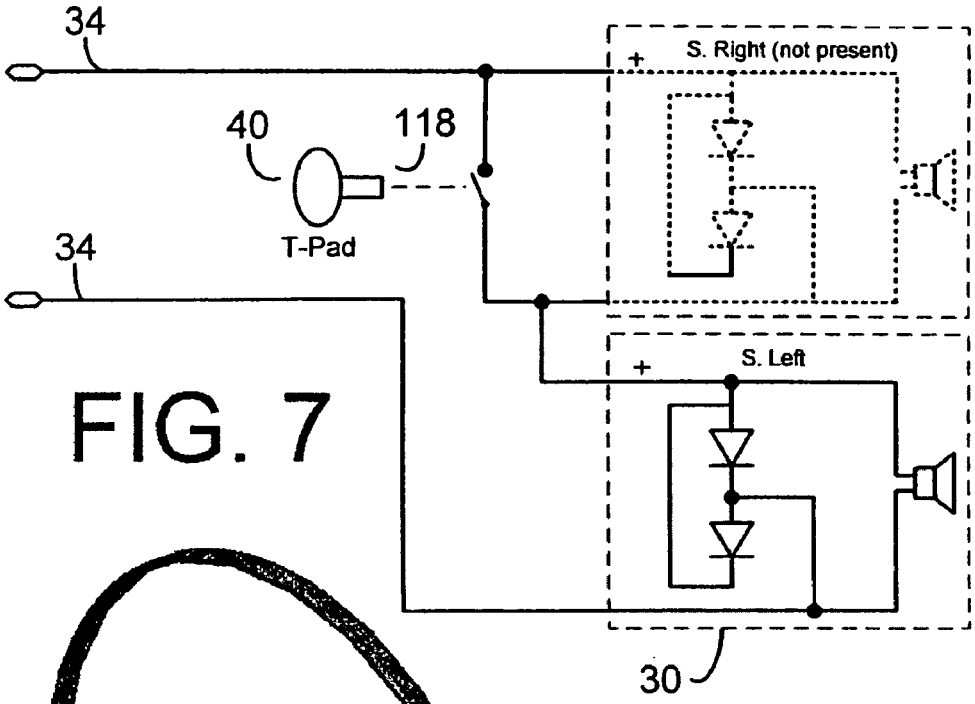
FIG. 7 is a schematic illustration of electrical wiring of the device of FIG. 1.

It should now be understood that the electrical wires 96 pass through the headband 20 and connect to the electrical wiring 34 at the first end of the headband 20. Electrical wiring 34 is also connected to transmit signals to the first speaker 30. Depending on the design, the wiring in the headset used to couple the right and left speakers may be configured in a manner intended to either couple the right and left speakers in parallel or in series. If a series connection wiring is employed, as shown in FIG. 7, the shunt 118 is used to short circuit the open circuit resulting from the absence of the right speaker assembly.

In operation, the user can easily connect the temple pad 40 to the second end 26 of the headband 20 and remove the temple pad 40 therefrom. To connect the temple pad 40, the user pushes plate 60 toward the second barrel part 50 and slides the barrel 46 over the connection cylinder 90 until the raised spring portions 114 and 116 of the second electrical connector 110 abut the electrical contacts 102 and 104 of the electrical connector 100. Then the user releases the plate 60 so that the springs 80 and 82 move the engagement member 70 in engagement with the channel 92, as shown in FIG. 4. Hence, the engagement member 70 mechanically connects the temple pad 40 to the second end 26 of the headband 260, while the shunt 118 short circuits an open circuit if series connected wiring has been employed.

Figure 8:
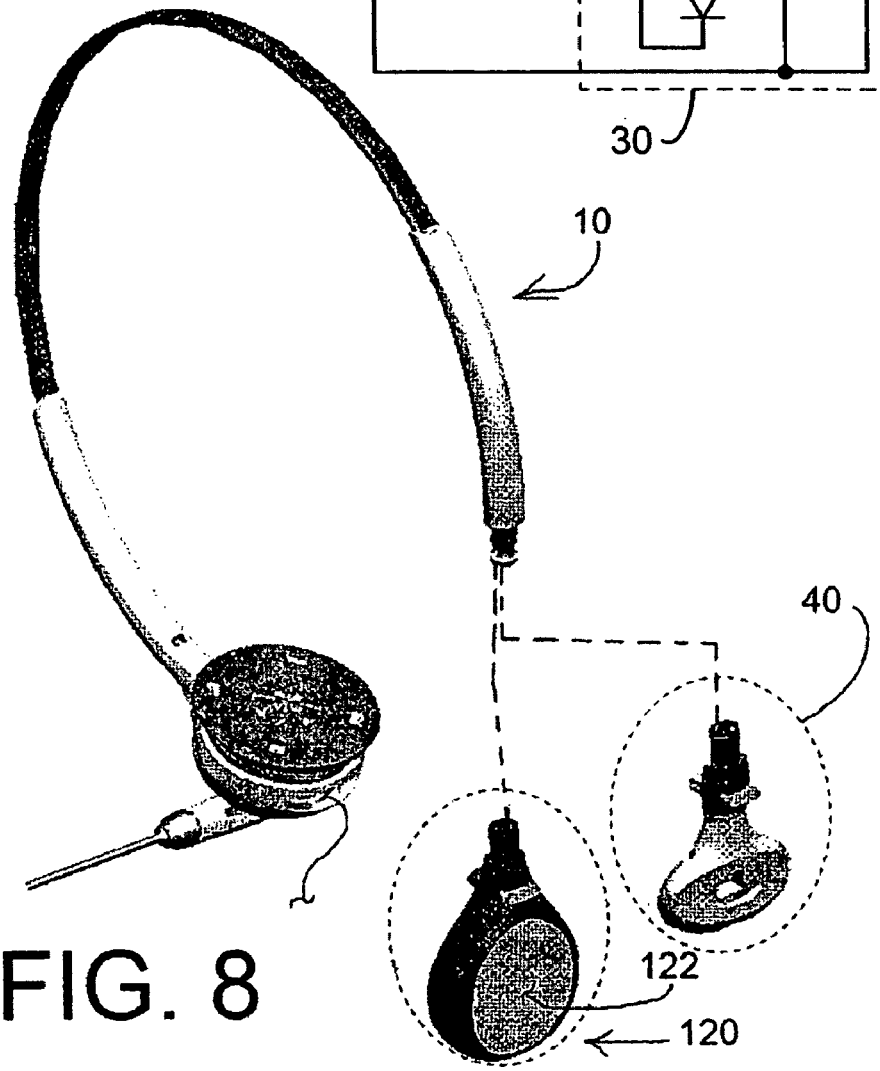
FIG. 8 is a schematic illustration indicating the conversion of the device between a monaural and a binaural configuration.
Figure 9:
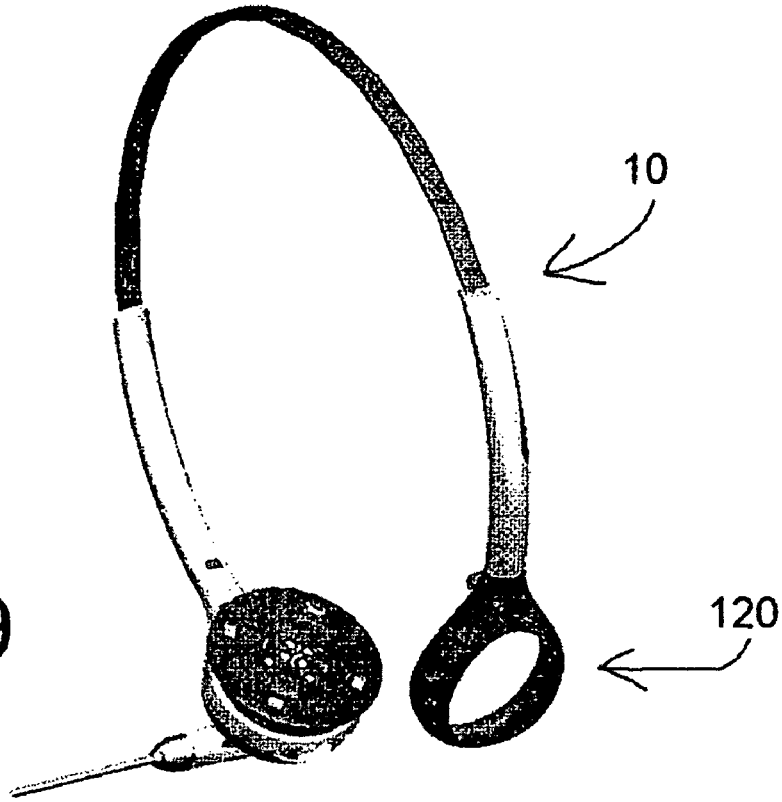
FIG. 9 is an isometric view of the convertible headset in a binaural configuration, according to an embodiment of the present invention.
Figure 10:
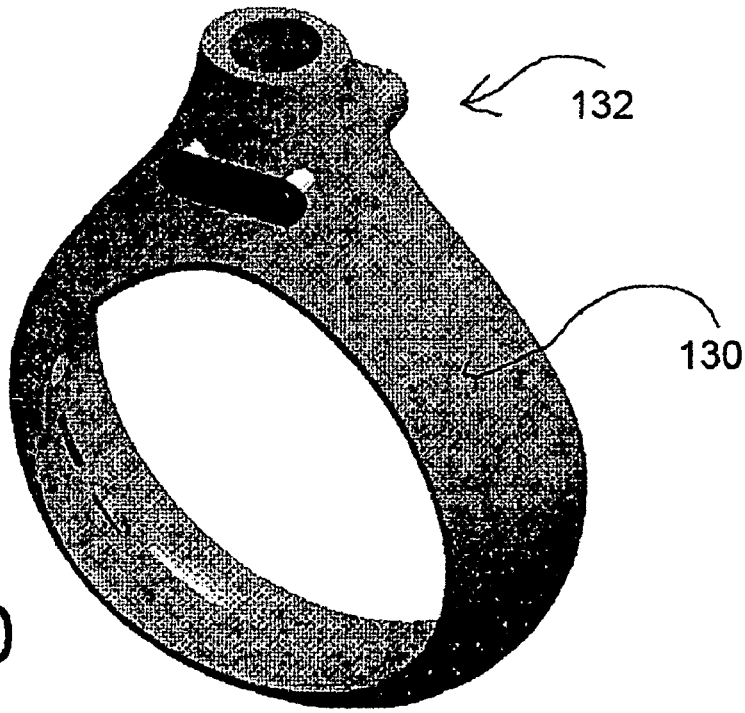
FIG. 10 is an isometric view of a portion of the speaker module.
Figure 11:
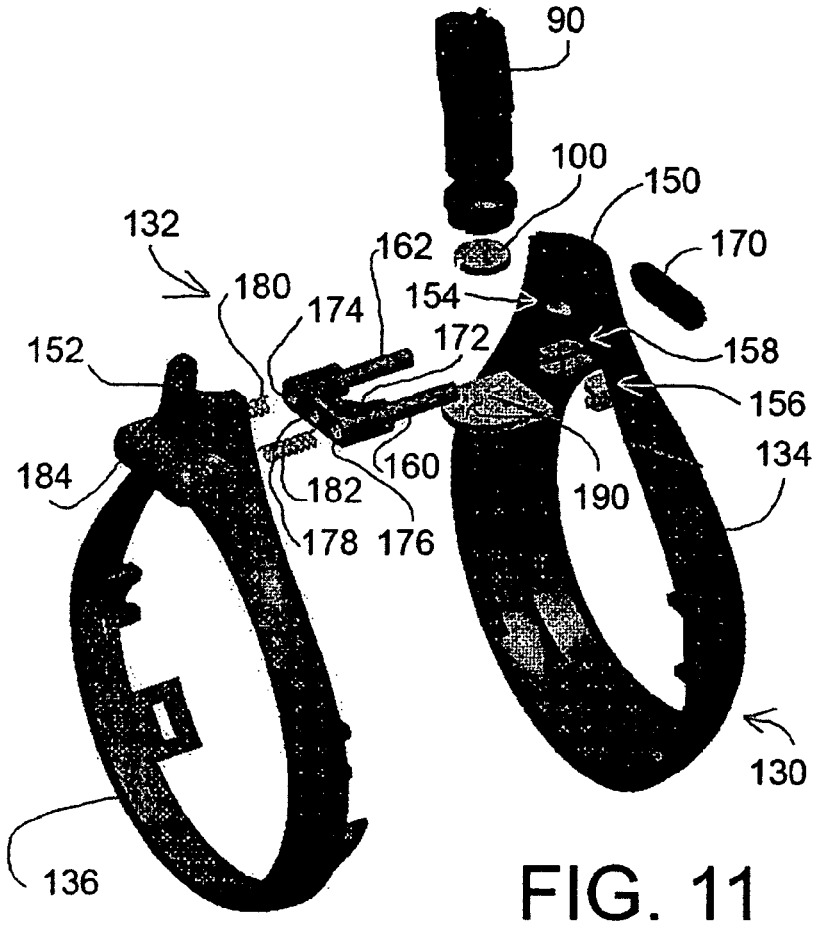
FIG. 11 is an exploded, isometric view of the speaker module and part of the headband of the headset.

According to an embodiment of the invention, a user can easily convert the monaural headset system described above to a binaural system. To do so the user simply removes the temple pad 40 and replaces it with a speaker module 120, as indicated by dashed lines in FIG. 8. The user accomplishes this by first pushing the plate 60 of the temple pad 40 to disengage the engagement member 70 from the channel 92 and pulling the temple pad 40 downward from the connection cylinder 90. Then the user mounts the speaker module 120 in substantially the same way the temple pad 40 was mounted. Since the temple pad 40 and the speaker module 120 each terminate the headband 20, they can be considered to be termination members. FIG. 9 shows the convertible headset 10 with the speaker module 120 installed. For the purposes of illustration certain components 122 of the speaker module 120 are generally indicated in FIG. 8 but not illustrated in FIG. 9 and other figures.

FIGS. 10-13 show the speaker module 120 in more detail. The speaker module 120 includes a generally circular housing member 130 and a lock assembly 132. Speaker components, which can be designed by one of ordinary skill in the art, are housed in the housing member 130. The housing member 130 has generally circular first and second sides 134 and 136, which can be snapped together to contain the internal speaker components, some of which are not shown. The upper part of the circular sides 134 and 136 comprises a lock assembly 132 that includes a first barrel part 150 formed integrally with the first circular side 134 and a second barrel part 152 formed integrally with the second circular side 136. The first barrel part 150 has two cylindrical through holes, only one of which (hole 154) is shown. The two holes cooperate with two cylindrical pins 160 and 162, which can slide in the holes. A plate 170 is mounted to the ends of the pins 160 and 162, which are exterior of the first barrel part 150, and an engagement member 172 is mounted to the ends of the pins 160 and 162, which are interior of the first and second barrel parts 150 and 152.

The engagement member 172 is generally U-shaped. Two blind holes 174 and 176 are formed in a base of the U along axes coincident with the longitudinal axes of the pins 160 and 162. A third hole 178 is formed in the middle of the base of the U. First and second springs 180 and 182 are mounted in the holes 174 and 176. A well 184 is formed in the second barrel part 152 to cooperate with the springs 180 and 182 and the engagement member 172. The well 184 includes a pin, not shown, to cooperate with hole 178 in the engagement member 172, similar to the structure shown in FIG. 4 and discussed above. The springs 180 and 182 bias the engagement member 172 away from the second barrel part 152.

Figure 12:
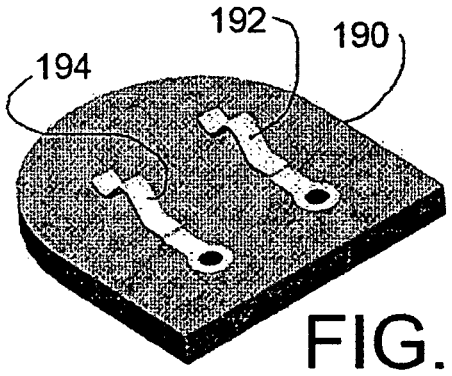
FIG. 12 is a view of an electrical connector of the headset.

As best shown in FIG. 12, a third electrical connector 190 having electrical contacts 192 and 194 is mounted in the speaker module 120. Guides 156 and 158 are mounted in the first barrel 150 to receive and hold the electrical connector 190. The two electrical contacts 192 and 194 have raised spring portions that extend from the third electrical connector 190. The electrical contacts 192 and 194 include wires, not shown, which run through the connector 190 to the side thereof not shown in FIG. 12 and from there to electronic components of the speaker module 120.

In operation, the user can easily connect the speaker module 120 to the second end 26 of the headband 20 and remove the speaker module 120 therefrom. To connect the speaker module 120 the user pushes the plate 170 toward the second barrel part 152 and slides the barrel over the connection cylinder 90 until the electrical contacts 192 and 194 of the third electrical connector 190 abut the electrical contacts 102 and 104 of the electrical connector 100. Then the user releases the plate 170 so that the springs 180 and 182 move the engagement member 172 so that it engages the channel 92. The engagement member 172 then mechanically connects the speaker module 120 to the second end 26 of the headband 20 while the third electrical connector 190 connects the electrical wiring to the speaker module 120.

Figure 14:
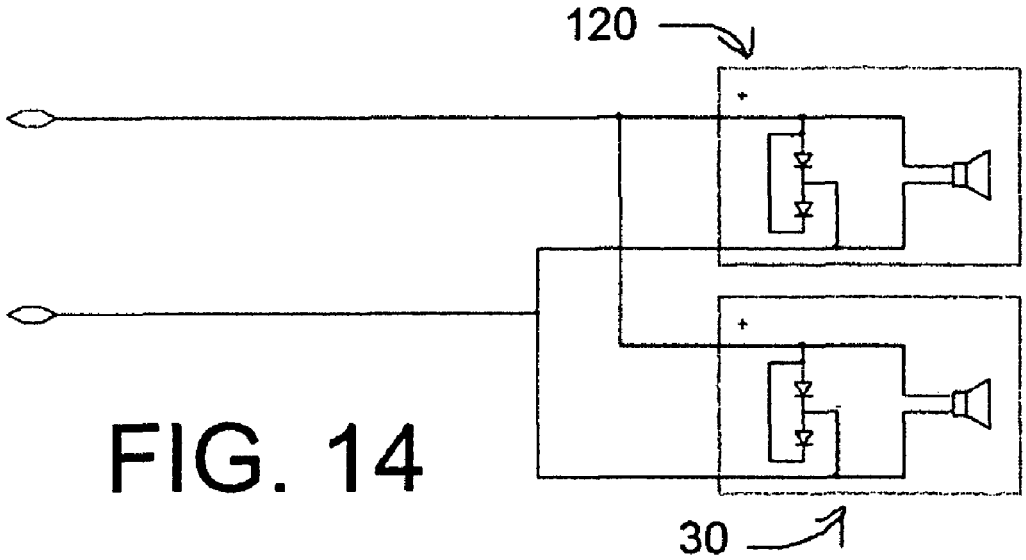
FIG. 14 is a schematic illustration of electrical wiring of the device in a binaural, monophonic configuration.
Figure 15:
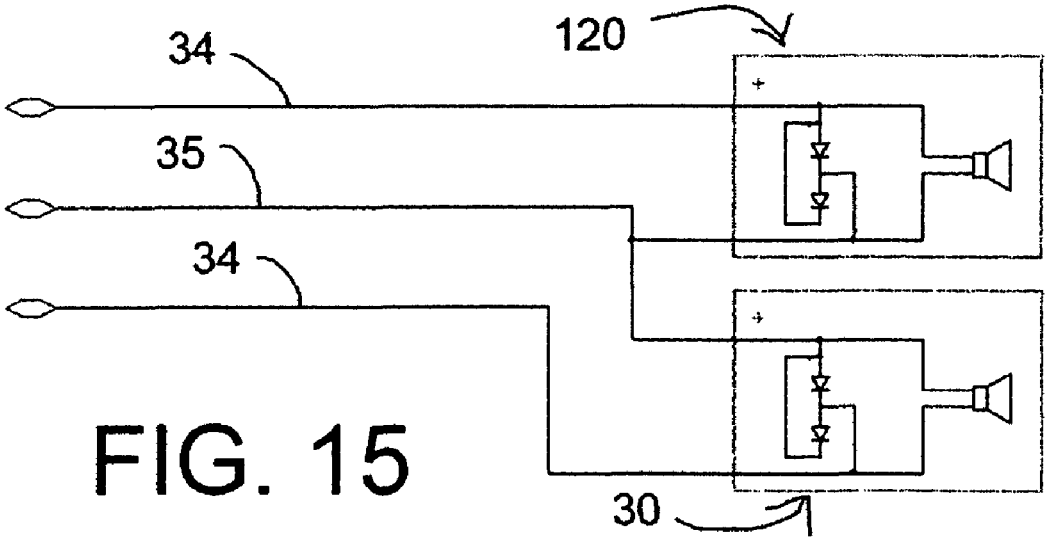
FIG. 15 is a schematic illustration of electrical wiring of the device in a binaural, stereophonic configuration.

It should now be understood that the wires 96 pass through the headband 20 and connect to the electrical wiring 34 at the first end of the headband. As is schematically illustrated in FIG. 14, electrical wiring 34 is connected to wiring 96 which in turn is connected to speaker module 120. Electrical wiring 34 is also configured to transmit signals to first speaker 30. It should be recognized that as the wiring is structured in FIG. 14 both speakers are driven by the same signal and therefore they both produce the same sound. However, if it should be desired to provide stereophonic sound, the headset is wired as shown in FIG. 15, and an additional signal source is provided via wire 35.

Although the present invention has been described with reference to specific embodiments thereof, these embodiments are merely illustrative, and not restrictive, of the present invention. Various modifications or changes to the specifically disclosed exemplary embodiments will be suggested to persons skilled in the art. For example, whereas the connection cylinder 90 is described in the exemplary embodiments as being part of the headband assembly, in an alternative embodiment similar connection cylinders or adapters can be assembled to each of the temple pad 40 and speaker module 120 assemblies. Further, the locking assembly described in the exemplary embodiments could be alternatively assembled at an end of the headband 20, rather than as part of the temple pad 40 and speaker module 120 assemblies. Still further, while the exemplary embodiments have been described in terms of a wired headset, many of the features and benefits offered by the present invention may be implemented in a wireless headset. Accordingly, the scope of the invention should not be restricted to specific exemplary embodiments disclosed herein, and all modifications that are readily suggested to those of ordinary skill in the art should be included within the spirit and purview of this application and scope of the appended claims.

What is claimed is:

1. A headset comprising:

a headband having a first end and a second end;

a first speaker affixed to the first end of said headband; and a termination member connected to the second end of the headband and configured to be removably connectable to the second end of the headband, wherein said second end of said headband comprises a first connection member;

said termination member comprises a second connection member; and said first connection member is constructed and arranged to cooperate with said second connection member so that a user can disengage said connection members from each other by applying force to at least one of said connection members;

wherein said first connection member comprises a cylinder with a channel formed about its circumference;

said second connection member comprises a locking member which is biased by a spring member to engage with said channel; and said locking member is capable of being disengaged from said channel by a user applying force against the spring member.

2. The headset according to claim 1 wherein said termination member comprises a temple pad.

3. The headset according to claim 1 wherein said termination member comprises a speaker assembly.

4. The headset according to claim 1, further comprising a microphone connected to said headset.

5. A convertible headset system comprising:

a headband having a first end and a second end;

a first speaker affixed to the first end of said headband;

a temple pad configured to be removably connectable to the second end of the headband; and a second speaker configured to be removably connectable to the second end of the headband; wherein said second end of said headband comprises a first connection member; said temple pad comprises a second connection member; and said first connection member is constructed and arranged to cooperate with said second connection member so that a user can disengage said connection members from each other by applying force to at least one of said connection members; wherein said first connection member comprises a cylinder with a channel formed about its circumference;

said second connection member comprises a locking member which is biased by a spring member to engage with said channel; and said locking member is capable of being disengaged from said channel by a user applying force against the spring member.

6. The headset according to claim 5, further comprising a microphone connected to said headset.

7. A convertible headset system comprising:

a headband having a first end and a second end;

a. first speaker affixed to the first end of said headband;

a temple pad configured to be removably connectable to the second end of the headband; and a second speaker configured to be removably connectable to the second end of the headband; wherein said second end of said headband comprises a first connection member;

said second speaker comprises a second connection member; and said first connection member is constructed and arranged to cooperate with said second connection member so that a user can disengage said connection members from each other by applying force to at least one of said connection members; wherein said first connection member comprises a cylinder with a channel formed about its circumference;

said second connection member comprises a locking member which is biased by a spring member to engage with said channel; and said locking member is capable of being disengaged from said channel by a user applying force against the spring member.

8. A convertible headset system comprising:

a headband having a first end and a second end;

a first speaker affixed to the first end of said headband;

a termination member connected to said second end of said headband; and connection means connected to said second end of said headband and said termination member to permit a user to disconnect said termination member from said second end of said headband by applying pressure to at least a portion of said connection means; wherein said connection means comprises:

a cylinder with a channel formed about its circumference;

a locking member which is biased by a spring member to engage with said channel; and said locking member is capable of being disengaged from said channel by a user applying force against the spring member.

9. The convertible headset system according to claim 8 wherein said termination member comprises a temple pad.

10. The convertible headset system according to claim 8 wherein said termination member comprises a speaker assembly.

11. A convertible headset system according to claim 8 further comprising a microphone connected to said headset.

12. The convertible headset system according to claim 8 wherein said connection means provides electrical connection between said headband and said termination member and further comprises a mechanical connection between said headband and said termination member.

* * * * *